US010661863B1

(12) United States Patent
Gomez

(10) Patent No.: US 10,661,863 B1
(45) Date of Patent: May 26, 2020

(54) HYDRODYNAMIC SURFBOARD

(71) Applicant: Guillermo Gomez, San Borja (PE)

(72) Inventor: Guillermo Gomez, San Borja (PE)

( * ) Notice: Subject to any disclaimer, the term of this patent is extended or adjusted under 35 U.S.C. 154(b) by 29 days.

(21) Appl. No.: 16/008,467

(22) Filed: Jun. 14, 2018

(51) Int. Cl.
*B63B 35/79* (2006.01)

(52) U.S. Cl.
CPC ..... *B63B 35/7906* (2013.01)

(58) Field of Classification Search
CPC .. B63B 35/7906; B63B 35/79; B63B 35/7926
See application file for complete search history.

(56) References Cited

U.S. PATENT DOCUMENTS 3,323,154 A * 6/1967 Lambach ..... B63B 35/7906 441/74
4,894,035 A * 1/1990 Pia ..... B63B 35/71 441/65
9,011,191 B2 4/2015 Connor
9,440,715 B2 9/2016 Rizzo
2007/0065627 A1* 3/2007 Chang ..... B32B 3/30 428/72
2011/0318979 A1* 12/2011 Bradley ..... B63B 35/7906 441/74
2012/0263916 A1* 10/2012 Green ..... A63C 17/017 428/138
2013/0102210 A1* 4/2013 Wilbur ..... B63B 35/79 441/74
2015/0024644 A1* 1/2015 Hantz ..... B63B 35/7906 441/74
2019/0185113 A1* 6/2019 O'Rourke ..... B63B 35/79

* cited by examiner

*Primary Examiner* — Stephen P Avila
(74) *Attorney, Agent, or Firm* — Sanchelima & Associates, P.A.; Christian Sanchelima; Jesus Sanchelima

(57) ABSTRACT

An apparatus comprising a board such as a surfboard or body board is disclosed. The board comprises a top deck and a bottom. The board comprises a forward end and a rear end. The distance between the forward end and the rear end defines a length of the board. The board further comprises rails provided at side of the board, which defines a width of the board. The rails are provided in a step-like structure to reduce thickness of the rails coming in contact with wave water wall. The board further comprises a cut-section provided at bottom along longitudinal axis of the board to reduce resistance against surface of the water when in motion. The board further comprises a set of fins provided at bottom near the rear end. Further, the board comprises at least one stringer at its center to strengthen the board, reduce deformation, and add stiffness to the board.

18 Claims, 9 Drawing Sheets

HYDRODYNAMIC SURFBOARD

BACKGROUND OF THE INVENTION

1. Field of the Invention

The present disclosure generally relates to recreational sport devices such a surfboard and/or a body board. In particular, the present disclosure relates to surfboard that increases speed a surfer can ride waves and increases stability.

2. Description of the Related Art

It is known that surfboards and body boards are used along the seashores and coasts throughout the world. Typically, the surfboards are used to surf on water where a rider stands upright on a relatively long and narrow surfboard. A typical surfboard as known in the art is depicted in FIG. 1A.

Referring to FIG. 1A-1E, a surfboard 10, in accordance with prior art is shown. Specifically, FIGS. 1A, 1D and 1E, a front, a top perspective and a bottom perspective view of the surfboard 10, respectively is shown. As can be seen in FIGS. 1A, 1D and 1E, the surfboard 10 comprises a top deck 12, a bottom 14, a forward end 16, a rear end 18, two rails 20, 22 and a set of fins 24 attached to the bottom 14 near the rear end 18. Traditionally, the top deck 12 is provided in a concave or flat shape as shown in FIG. 1B. As known, the rails 20 and 22 provided at side of the surfboard 10 facilitate in turning the surfboard 10. Typically, the rails 20 and 22 at side of the surfboard 10 are provided in a curved or round shape as shown in FIG. 1C. In order to turn the surfboard 10, a rider may pushdown to apply pressure on one rail e.g., rail 20 so that more of the rail 20 of the surfboard 10 comes in contact with the water. The surface tension of water moving along the bottom 14 and the rail 20 of the surfboard 10 causes the water to attempt to adhere to the rail 20 of the surfboard 10. The increased surface area of the surfboard 10 placed in contact with the water, in combination with the effect of the adhesion of the water to the rail 20 of the surfboard 10 causes increased resistance or drag in the water on the side of the surfboard 10 pushed down into the water, which, in turn, pulls the surfboard 10 in that direction.

With improvements in design of the surfboard 10, several designs have been proposed to have a stringer 26 in the surfboard 10. The stringer 26 is a flexible tube or rod that is inserted in the surfboard 10 to give additional strength to the surfboard 10. The stringer 26 is used to reduce deformation and keep the surfboard 10 intact when forced to major pressures. As can be seen in FIGS. 1A, 1D and 1E, the stringer 26 is provided at center of the surfboard 10.

Several attempts have been made in the past to provide the surfboards in various shapes. Some of the examples were disclosed in a U.S. Pat. Nos. 9,011,191 and 9,440,715. In U.S. Pat. No. 9,011,191, a surfboard that can be controlled from either end and that allows three hundred sixty degrees of directional capabilities parallel to the surface of the water is disclosed. In U.S. Pat. No. 9,440,715, a surfboard comprising a pair of knee wells for accommodating the knees of the rider when the surfboard is used as a kneeboard is disclosed.

Although the above disclosures allow the rider to surf the water, there are several problems associated with existing designs. As specified above, the top deck 12 is provided in a concave or flat shape. Several designs have been proposed where the bottom 14 is provided in a belly, flat, concave, V-shape, tail channels and tri-plane hull shape. Due to its structure e.g., concave, V-shape at the bottom 14, the surfboard 10 has higher resistance against surface of the water when the surfboard 10 is in motion. Now referring to FIGS. 1F and 1G, a side cross-sectional view of the surfboard 10 in which a flat surface and a cut-section 28 at rear end 18 of the surfboard 10 is shown. It should be noted that the cut-section at the rear end is provided to allow the water to flow out of the surfboard 10 easily. However, due to its relatively flat or curved structure at the bottom 14, balancing and maneuvering of the surfboard 10 becomes difficult. Further, it is difficult to obtain higher speeds as water resists against the bottom 14 of the surfboard 10 when the surfboard 10 is in motion, especially at the belly bottom.

Other documents describing the closest subject matter provide for a number of more or less complicated features that fail to solve the problem in an efficient and economical way. None of these patents suggest the novel features of the present invention. Specifically, none of the disclosures in the art disclose an apparatus comprising a board used to surf water, wherein the board comprises a cut-section at the bottom to reduce resistance against surface of the water when in motion.

Therefore, there is a need in the art for an apparatus comprising a board having a cut-section at the bottom to reduce resistance against surface of the water when in motion.

SUMMARY OF THE INVENTION

It is one of the main objects of the present invention to provide an apparatus for travelling in ocean surf and avoids the drawbacks of the prior art.

It is one object of the present invention to provide an apparatus that reduces resistance against surface of the water when in motion.

It is one object of the present invention to provide an apparatus comprising rails with reduced thickness, which allows the rails to have minimum contact with wave water wall.

It is one object of the present invention to provide an apparatus comprising a board such as a surfboard or body board. The board comprises a top deck and a bottom. The board comprises a forward end and a rear end. The distance between the forward end and the rear end defines a length of the board. The board further comprises rails provided at side of the board, which defines a width of the board. The rails are provided in a step-like structure to reduce thickness of the rails coming in contact with wave water wall.

It is one object of the present invention to provide an apparatus comprising a board such as a surfboard or body board. The board comprises a top deck and a bottom. The board comprises a forward end and a rear end. The distance between the forward end and the rear end defines a length of the board. The board further comprises rails provided at side of the board, which defines a width of the board. The rails are provided in a step-like structure to reduce thickness of the rails coming in contact with wave water wall. The board further comprises a cut-section provided at bottom along longitudinal axis of the board to reduce resistance against surface of the water when in motion.

It is another object of the present invention to provide at least one stringer to the board at its center. The stringer is added to strengthen the board, reduce deformation, and add stiffness to the board. The apparatus further comprises a set of fins provided at bottom near the rear end.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses an apparatus comprising a board such as a surfboard or body board. The board comprises a top deck and a bottom. The board comprises a forward end and a rear end. The distance between the forward end and the rear end defines a length of the board. The board further comprises rails provided at side of the board, which defines a width of the board. The rails are provided in a step-like structure to reduce thickness of the rails coming in contact with wave water wall. The board further comprises a cut-section provided at bottom along longitudinal axis of the board to reduce resistance against surface of the water when in motion. The board further comprises a set of fins provided at bottom near the rear end. Further, the board comprises at least one stringer at its center to strengthen the board, reduce deformation, and add stiffness to the board.

Various features and embodiments of the apparatus for travelling in ocean surf are explained in conjunction with the description of FIGS. 2A-6.

Figure 1B:
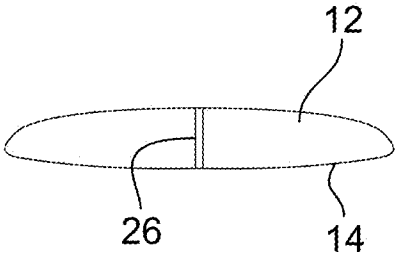
FIG. 1B ( Prior Art )
FIGS. 1A and 1B illustrate a front and front side perspective view of a surfboard 10, in accordance with prior art.
Figure 1C:
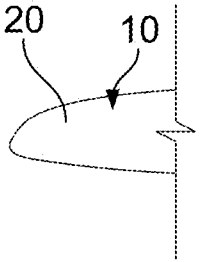
FIG. 1C ( Prior Art )
FIG. 1C illustrates a shape of a rail 20 of the surfboard 10, in accordance with prior art.
Figure 1A:
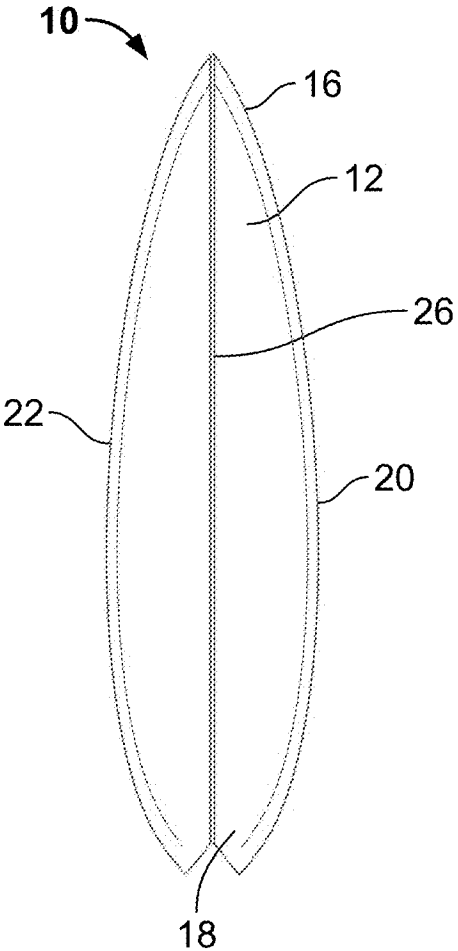
FIG. 1A ( Prior Art )
Figure 1D:
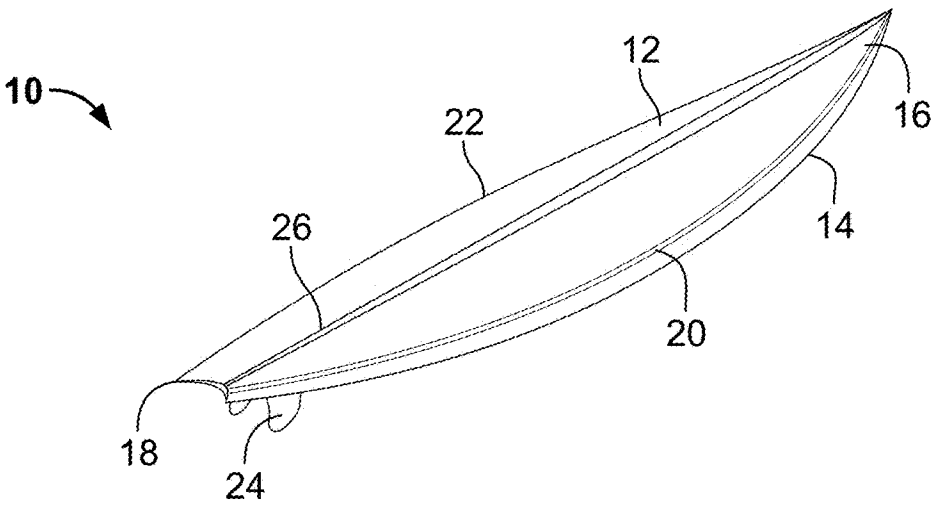
FIG. 1D ( Prior Art )
FIGS. 1D and 1E illustrate a top perspective view and a bottom perspective view of the surfboard 10, in accordance with prior art.
Figure 1E:
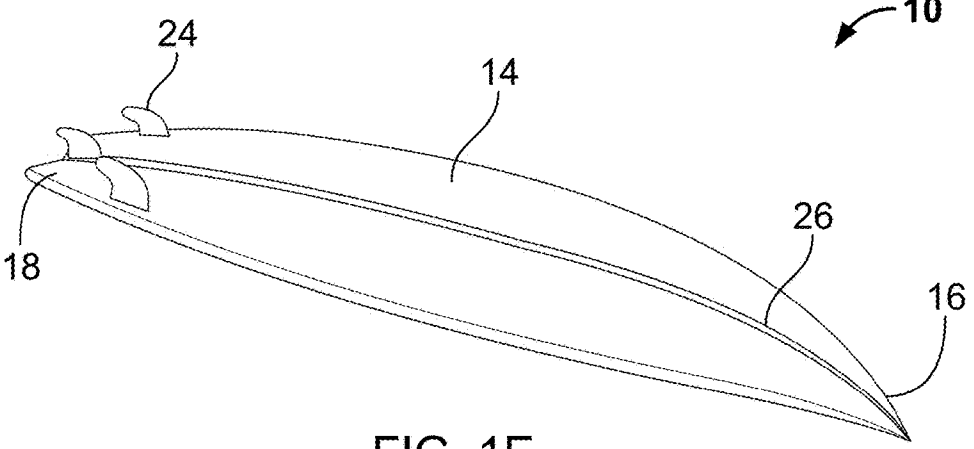
FIG. 1E ( Prior Art )
Figure 1F:
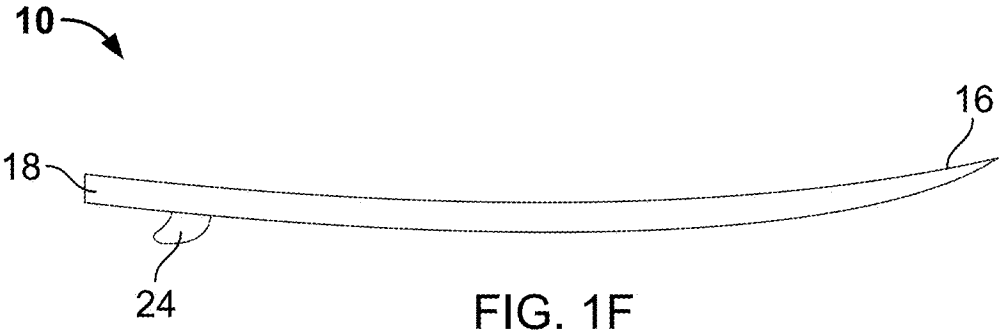
FIG. 1F ( Prior Art )
FIGS. 1F and 1G illustrate a side cross-sectional view of the surfboard 10 in which a flat surface and a cut-section 28 at a rear end 18 of the surfboard 10, in accordance with prior art.
Figure 1G:
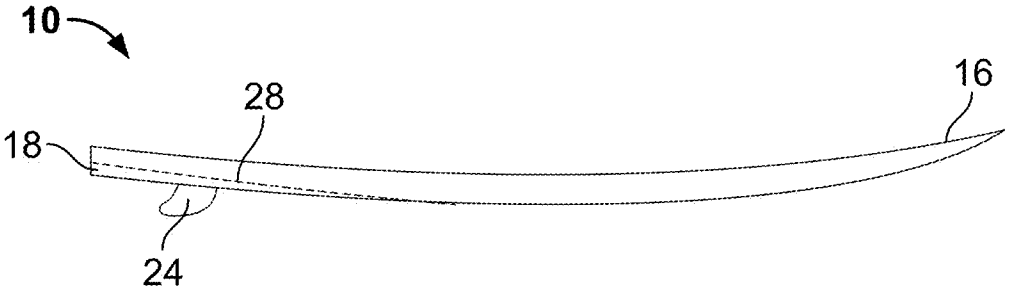
FIG. 1G ( Prior Art )
Figure 2A:
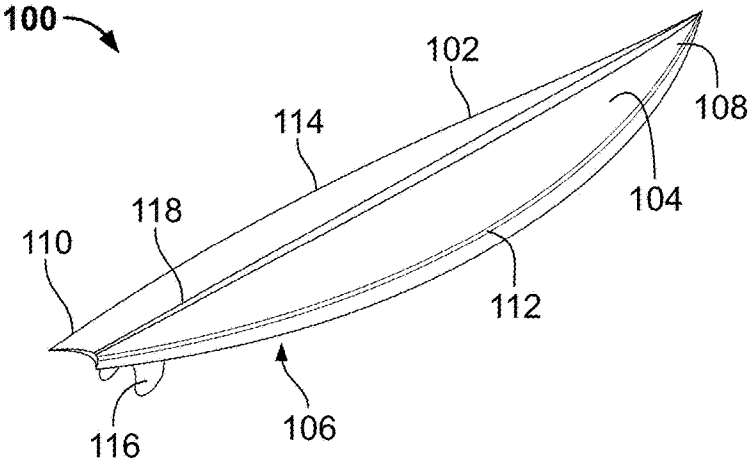
FIGS. 2A and 2B illustrate a top perspective view and a front view of an apparatus 100 for travelling in ocean surf, in accordance with one embodiment of the present disclosure.
Figure 2B:
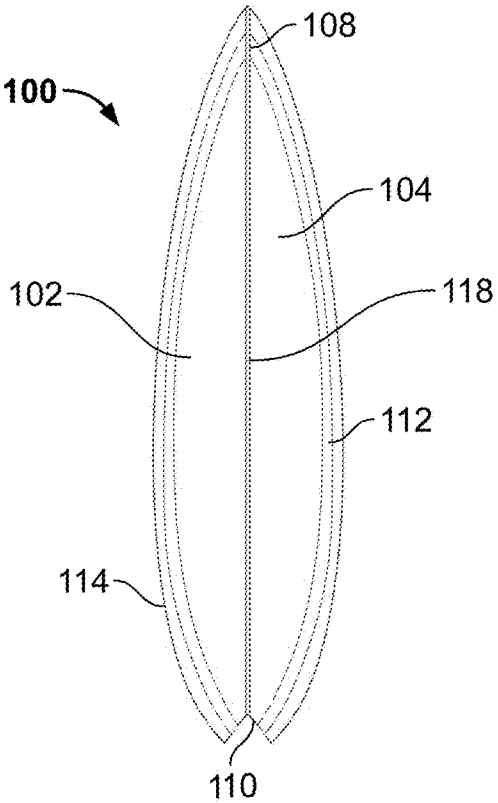
Figure 2C:
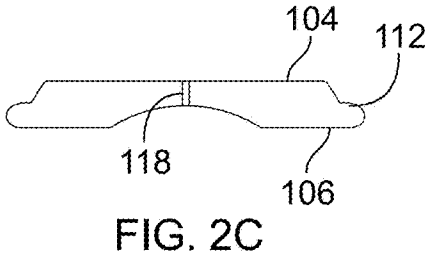
FIGS. 2C and 2D illustrate a flat and concave shape of a top deck 104, in accordance with one embodiment of the present disclosure.
Figure 2D:
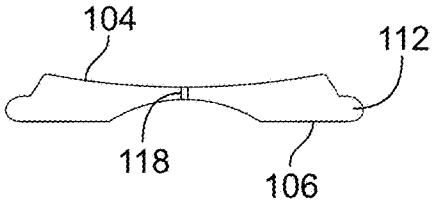

Referring to FIGS. 2A and 2B, a perspective view and a front view, respectively of an apparatus 100 for travelling in ocean surf is shown, in accordance with one embodiment of the present disclosure. The apparatus 100 comprises a board 102 is shown. The board 102 is made up of a rigid foam plastic core, such as expanded polystyrene or formed of a fiberglass shell with a rigid polyurethane core and so on. The board 102 may include a surfboard or a body board. The board 102 comprises a top deck 104 and a bottom 106. The top deck 104 indicates a top portion of the board 102 and the bottom 106 indicates under side of the board 102. Now referring to FIGS. 2C and 2D, shape of the top deck 104 is explained. When in use, a user of the apparatus 100 stands on the board 102. It should be understood that the apparatus 100 may also be used a body board wherein the user may lie down on the board 102 to surf the water. It should be understood that the top deck 104 might be provided in a flat structure as shown in FIG. 2C. In another example, the top deck 104 might be provided in a concave structure as shown in FIG. 2D. The top deck 104 is provided in a flat or concave structure to provide steadiness to feet of the user when the apparatus 100 is in motion.

The board 102 comprises a forward end 108, a rear end 110, and two rails 112, 114. It should be understood that the board 102 is defined; by a length disposed between the forward end 108 and the read end 110 and a width disposed between the (side) rails 112 and 114.

Figure 3A:
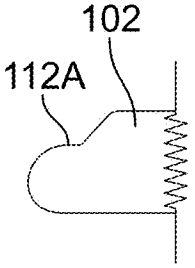
FIGS. 3A, 3B and 3C illustrate a steep, square, and sharp edged step like structure, respectively of rails 112 and 114, in accordance with one embodiment of the present disclosure.
Figure 3B:
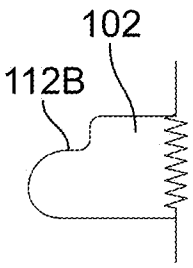
Figure 3C:
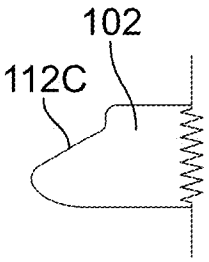

In accordance with one embodiment of the present disclosure, the rails 112 and 114 are provided in a step-like structure or stair-section shape. Referring to FIGS. 3A, 3B and 3C, the step-like structure of the rails 112 and 114 is explained. In one example, the rails 112 and 114 are provided in a double belt of a steep like structure as shown in FIG. 3A. In another example, the rails 112 and 114 are provided in a double belt of a square like structure as shown in FIG. 3B. In another example, the rails 112 and 114 are provided in a double belt of a sharp edge like structure as shown in FIG. 3C. It should be understood that the rails 112 and 114 are provided in a step-like structure or stair-section shape to reduce thickness of the rails 112 and 114 coming in contact with wave water wall. As the thickness of the rails 112 and 114 are reduced at the edges or corners, the board 102 is able to keep on track with the wave water wall.

Due to reduced thickness at the ails 112 and 114, when the user tries turn the apparatus 100 in motion, say by applying pressure on one rail e.g., rail 112 so that more of the rail 112 comes in contact with the water, the surface tension of water moving along the bottom 106 and the rail 112 causes the water to attempt to adhere to the rail 112 of the board 102. Due to reduced contact, resistance of drag in the water on side of the board 102 is reduced and the apparatus 100 will be easily turned in that direction.

The board 102 further comprises a set of fins 116 attached to the bottom 106 near the rear end 110. Referring to FIG.

Figure 4A:
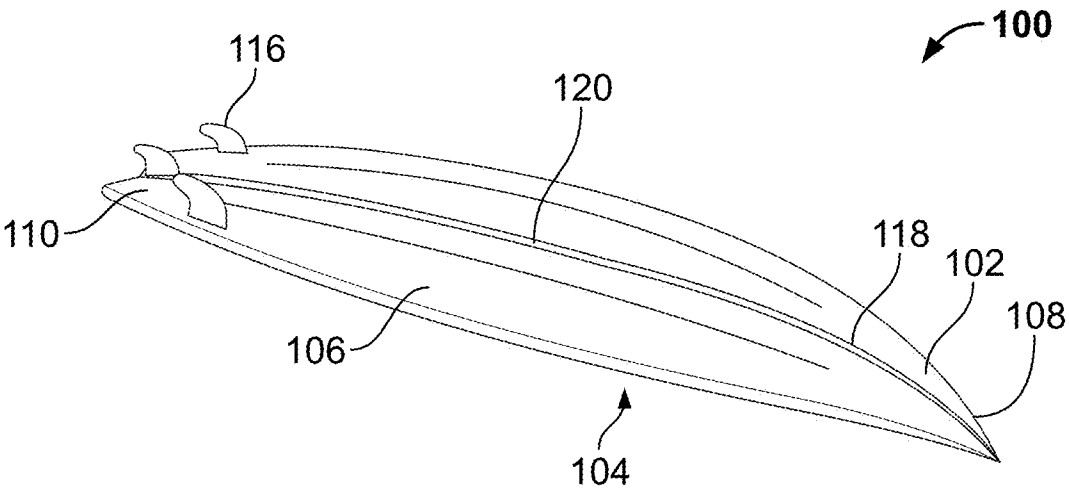
FIG. 4A illustrates a bottom perspective view of the apparatus 100, in accordance with one embodiment of the present disclosure.

4A, a bottom perspective view of the apparatus 100 is shown. As can be seen, the board 102 comprises the fins 116 attached to the bottom 106 near the rear end 110. The fins 116 are provided to improve directional stability and control through foot steering. Further, the board 102 comprises a stringer 118, as shown in FIGS. 2A, 2B and 4A. The stringer 118 is a flexible tube or rod inserted into the core of the board 102 at its center. The stringer 118 is provided in parallel to the rails 112 and 114. The stringer 118 is provided to strengthen the board 102, reduce deformation, add stiffness and spring-like recoil to the core.

Figure 4B:
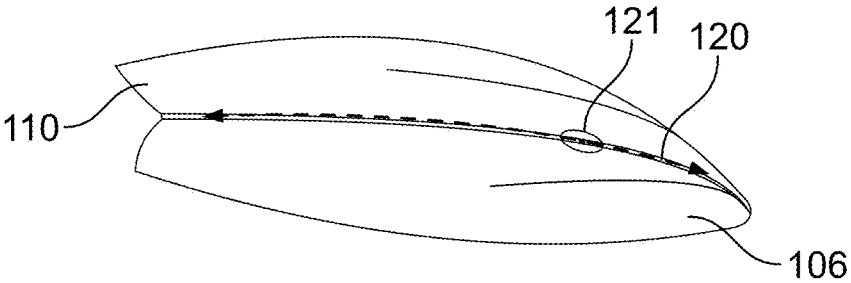
FIG. 4B illustrates a bottom perspective view of the apparatus 100 showing a center 121 of a cut portion at bottom 106 of the board 102, in accordance with one embodiment of the present disclosure.

In one implementation, the board 102 is provided with a cut section or tunnel 120 at the bottom 106. Specifically, the cut section 120 is formed out of a deep cut in the body of the board 102 at the bottom 106. In other words, the cut section 120 is provided in a longitudinal axis/craving sculpted in low relief at the bottom 106. Referring to FIG. 4B, the cut section 120 sculpted at the bottom 106 is shown. As can be seen, the cut section 120 originates at a center 121 of the board 120 in the bottom 106 and extends towards the ends of the board 102 i.e., the forward end 108 and rear end 110.

Figure 4C:
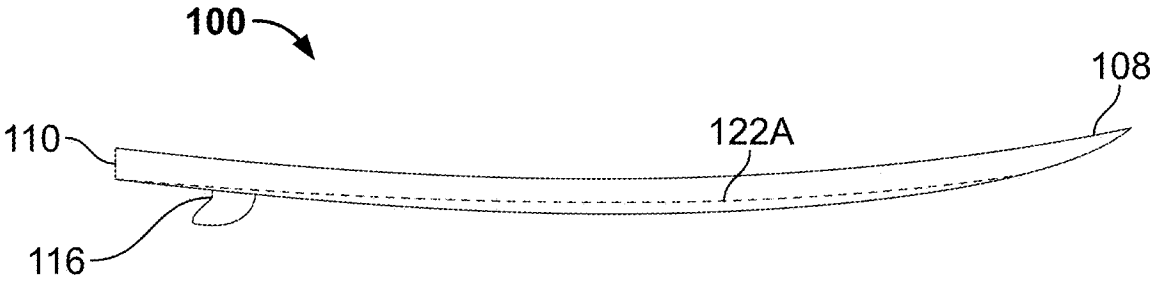
FIGS. 4C and 4D illustrate a side view of the apparatus 100 showing a slicing line 122A of the cut section 120 at the bottom 106, in accordance with one embodiment of the present disclosure.
Figure 4D:
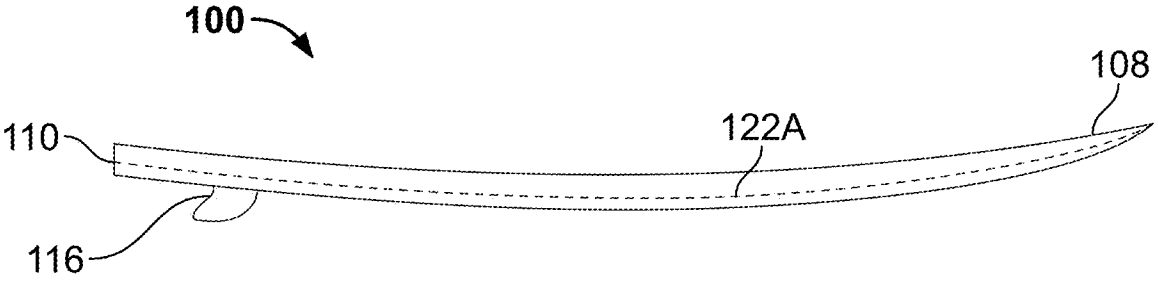

Referring to FIGS. 4C and 4D, a side view of the apparatus 100 showing a slicing line 122A of the cut section 120 at the bottom 106. The slicing line 122A indicates reference point of the cut section 120 that is cut at the bottom 106. In one example, the cut section 120 is provided in a partial manner i.e., the slicing line 122A depicted in FIG. 4C. In another example, the cut section 120 is provided in a complete manner, i.e., the slicing line 122A (from the forward end 108 to the rear end 110) depicted in FIG. 4D.

Figure 5B:
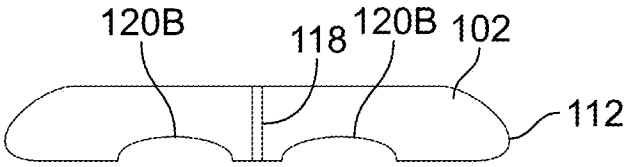
FIGS. 5A and 5B illustrate a single round, a double round, respectively of the cut section 120, in accordance with one embodiment of the present disclosure. More than two tunnels can be used in alternate embodiments.
Figure 5A:
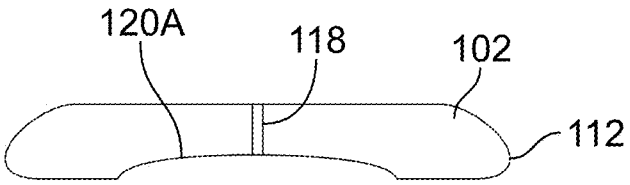

The cut section 120 can be provided in various shapes and sizes at the bottom 106 of the board 102 depending upon on the size and maneuvering needed when in water. Examples of the cut section 120 provided in different shapes are illustrated in FIG. 5A to 5D. Referring to FIG. 5A, a front side view of the board 102 illustrating a cut section 120A provided in a single round shape is shown. Referring to FIG. 5B, a front side view of the board 102 illustrating a cut section 120B provided in a double round shape is shown. Referring to FIG. 5C, a front side view of the board 102 illustrating a cut section 120C provided in a single square shape is shown. Referring to FIG. 5D, a front side view of the board 102 illustrating a cut section 120D provided in a double square shape is shown. It should be obvious to a person skilled in the art to provide the cut section 120 in various shapes other than the shapes shown therein and such implementations should be within the scope of the present disclosure.

Figure 6:
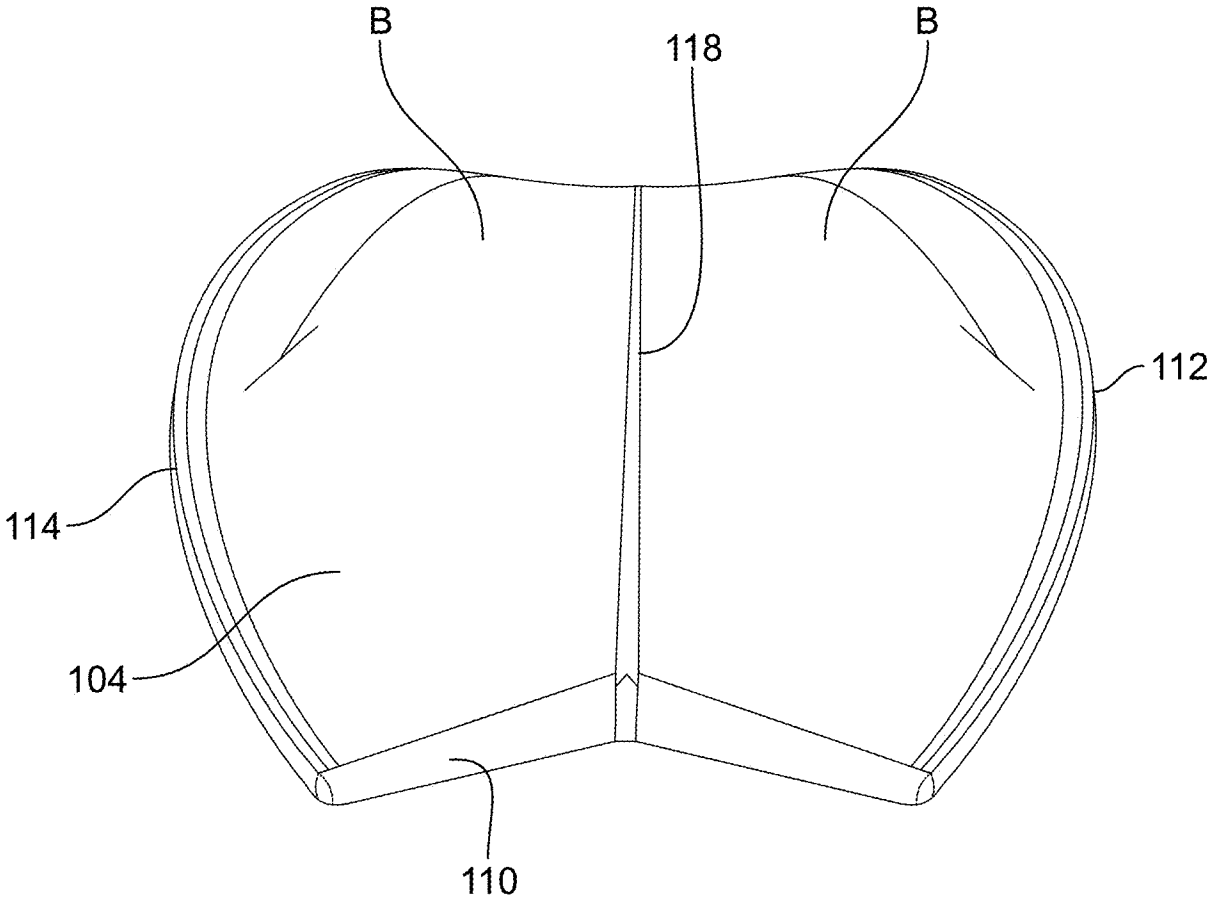
FIG. 6 illustrates a schematic diagram of the apparatus 100 illustrating buoyancy B towards its edges when the water moves in its main volumes, in accordance with one embodiment of the present disclosure.

The cut section 120 is provided at the bottom 106 to reduce resistance against surface of the water when in motion and to increase speed, balance and easy maneuvering. In other words, when the board 102 is in motion, water coming in contact with the bottom 106 is reduced due to the cut section 120, as water is made to pass through the cut section 120 which will result in less resistance on the bottom 106 against surface of the water. It should be understood that the apparatus 100, when in water, moves its main volumes of buoyancy B towards its edges as shown in FIG. 6. When the apparatus 100 moves its main volumes of buoyancy B towards its edges, central area of the board 102 (i.e., stringer 118) remains thinner. As a result, the apparatus 100 can attain increases speed due to the presence of the cut section 120 at the bottom and provides stability (paddling and riding balance) to the user of the apparatus 100.

It should be noted that the existing surfboards could be made to function similar to the apparatus described above by sculpting the rails at the side and sculpting a cut section at bottom of the board. As such, the present disclosure can be implemented on a new board (surfboard or body board) or existing boards to reduce resistance against water when in water and to increase speed, better balance and maneuvering. Further, the disclosure can be used to sculpt the boards made up of different materials, shapes and sizes. Furthermore, the board may be provided with the top deck having either a flat surface or concave surface to provide steadiness to feet of the user when the apparatus is in motion.

Although the present disclosure is explained to have a single stringer, it should be obvious to a person skilled in the art to include more than one stringer in the board to provide stability and better maneuvering.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hydrodynamic surfboard, comprising:

a board having a top deck, a bottom surface, a front side having a front distalmost end, a rear side having a rear distalmost end, said rear side having a plurality of fins, at least one tunnel indented into the thickness of the board a predetermined depth, said tunnel extends longitudinally along said bottom surface from said front side to said rear side without said tunnel reaching said front or rear distalmost end, wherein at least one of said plurality of fins is mounted within said at least one tunnel, wherein said at least one tunnel extends along a center of the width of said bottom surface of said board.

2. The hydrodynamic surfboard of claim 1 wherein said board is made of a rigid material.

3. The surfboard of claim 1 wherein said top deck is flat.

4. The surfboard of claim 1 wherein said top deck is concave.

5. The surfboard of claim 1 wherein said board includes a stringer extending longitudinally along said bottom surface.

6. The surfboard of claim 1 wherein said at least one tunnel includes sidewalls.

7. The surfboard of claim 6 wherein said sidewalls are curved.

8. The surfboard of claim 1 wherein said sidewalls are sloped.

9. The surfboard of claim 1 wherein said board includes rails on the outer lateral edges of the board, said sidewalls have the same curve as the rails.

10. The surfboard of claim 5 wherein said sidewalls are parallel to each other and to said stringer.

11. The surfboard of claim 1 wherein two tunnels are used, said two tunnels are separated by a partition extending out of the bottom surface of said board.

12. The surfboard of claim 1 wherein said board includes rails extending along the board's entire length, each of said rails includes a first and second rail, said first rail having a thickness equal to the thickness of the board adjacent to said first rail, said second rail extends outwardly from said board and has a thickness less than said first rail, said second rail is adapted to cut a wave with its reduced thickness, a corner spacing is created between said first rail and second rail.

13. The surfboard of claim 1 wherein said top deck is flat.

14. The surfboard of claim 1 wherein said top deck is concave.

15. A hydrodynamic surfboard, comprising:

a board having a top deck, a bottom surface, a front side having a front distalmost end, rear side having a rear distalmost end, said rear side having a plurality of fins, said board includes rails extending along the board's entire length, each of said rails includes a first and second rail, said first rail having a thickness equal to the thickness of the board adjacent to said first rail, said second rail extends outwardly from said board and has a thickness less than said first rail, said second rail is adapted to cut a wave with its reduced thickness, a corner spacing is created between said first rail and second rail, said board including at least one tunnel having sidewalls indented into the thickness of the board a predetermined depth, wherein said sidewalls have the same curve as said first rail and second rail.

16. The surfboard of claim 1, wherein said at least one tunnel is one tunnel centrally located with respect to the width of said bottom surface and extends from said rear side of said board to said front side of said board.

17. The surfboard of claim 1, wherein said at least one tunnel extends from a point short of said front side of said board towards said at least one fin and continues past said at least one fin towards a rear most side of said board.

18. A hydrodynamic surfboard, comprising:

a board having a top deck, a bottom surface, a front side having a front distalmost end, a rear side having a rear distalmost end, said rear side having at least one fin, at least one tunnel indented into the thickness of the board a predetermined depth, said tunnel extends longitudinally along said bottom surface from said front side to said rear side without said tunnel reaching said front or rear distalmost end, wherein said at least one fin is mounted within said at least one tunnel, wherein said at least one tunnel extends along a center of the width of said bottom surface of said board.

* * * * *